US012134801B2

(12) United States Patent
Bae

(10) Patent No.: US 12,134,801 B2
(45) Date of Patent: Nov. 5, 2024

(54) HIGH STRENGTH HOT ROLLED STEEL SHEET HAVING EXCELLENT ELONGATION AND METHOD FOR MANUFACTURING THE SAME

(71) Applicant: POSCO, Pohang-si (KR)

(72) Inventor: Jin-Ho Bae, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 643 days.

(21) Appl. No.: 17/295,929

(22) PCT Filed: Nov. 26, 2019

(86) PCT No.: PCT/KR2019/016309
§ 371 (c)(1),
(2) Date: May 21, 2021

(87) PCT Pub. No.: WO2020/111705
PCT Pub. Date: Jun. 4, 2020

(65) Prior Publication Data

US 2022/0025476 A1 Jan. 27, 2022

(30) Foreign Application Priority Data

Nov. 26, 2018 (KR) ..... 10-2018-0146879

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 9/46* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/48* (2013.01); *C22C 38/50* (2013.01); *C22C 38/58* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
None
See application file for complete search history.

(56) References Cited

U.S. PATENT DOCUMENTS

| | | | |
|---|---|---|---|
| 9,738,960 | B2 | 8/2017 | Kizu et al. |
| 2012/0031532 | A1 | 2/2012 | Ishikawa et al. |
| 2013/0092280 | A1 | 4/2013 | Sawamura et al. |
| 2016/0289788 | A1 | 10/2016 | Shibata et al. |
| 2018/0073097 | A1 | 3/2018 | Noh et al. |
| 2019/0062862 | A1 | 2/2019 | Nakata et al. |
| 2019/0316218 | A1 | 10/2019 | Jung |

FOREIGN PATENT DOCUMENTS

| | | | |
|---|---|---|---|
| CA | 3007073 | A1 | 8/2017 |
| CA | 3048358 | A1 | 8/2018 |
| JP | 2000-256783 | A | 9/2000 |
| JP | WO2011/052095 | A1 | 5/2011 |
| JP | 2016-006209 | A | 1/2016 |
| KR | 10-2013-0048796 | A | 5/2013 |
| KR | 10-2016-0090363 | A | 7/2016 |
| KR | 10-1649061 | B1 | 8/2016 |
| KR | 10-2017-0075936 | A | 7/2017 |
| KR | 10-2018-0074011 | A | 7/2018 |
| KR | 10-2018-0095917 | A | 8/2018 |

OTHER PUBLICATIONS

International Search Report dated Apr. 27, 2020 issued in International Patent Application No. PCT/KR2019/016309 (with English translation).
Extended European Search Report dated Aug. 27, 2021 issued in European Patent Application No. 19890581.2.

*Primary Examiner* — Anthony M Liang
(74) *Attorney, Agent, or Firm* — Morgan, Lewis & Bockius LLP

(57) ABSTRACT

The present invention provides a high strength hot rolled steel sheet and a method for manufacturing same, the steel sheet containing, in weight percentage, 0.11-0.14% of C, 0.20-0.50% of Si, 1.8-2.0% of Mn, 0.03% or less of P, 0.02% or less of S, 0.01-0.04% of Nb, 0.5-0.8% of Cr, 0.01-0.03% of Ti, 0.2-0.4% of Cu, 0.1-0.4% of Ni, 0.2-0.4% of Mo, 0.007% or less of N, 0.001-0.006% of Ca, 0.01-0.05% of Al, a balance of Fe and inevitable impurities, wherein relational expressions 1 to 3 below are satisfied, and a microstructure includes, by area percentage, 88% or more of bainite, 10% or less of ferrite, 2% or less of pearlite, and 0.8% or less of island martensite. [Relational Expression 1] $7 \leq (Mo/93)/(P/31) \leq 16$. [Relational Expression 2] $1.6 \leq Cr+3Mo+2Ni \leq 2$. [Relational Expression 3] $6 \leq (3C/12+Mn/55) \times 100 \leq 7$.

6 Claims, No Drawings

HIGH STRENGTH HOT ROLLED STEEL SHEET HAVING EXCELLENT ELONGATION AND METHOD FOR MANUFACTURING THE SAME

CROSS-REFERENCE OF RELATED APPLICATIONS

This application is the U.S. National Phase under 35 U.S.C. § 371 of International Patent Application No. PCT/KR2019/016309, filed on Nov. 26, 2019, which in turn claims the benefit of Korean Application No. 10-2018-0146879, filed on Nov. 26, 2018, the entire disclosures of which applications are incorporated by reference herein.

TECHNICAL FIELD

The present disclosure relates to a high strength hot rolled steel sheet having excellent elongation and a method for manufacturing the same, and more particularly, to a hot rolled steel sheet that may be used for construction, pipelines and oil wells, and the like, and a method for manufacturing the same.

BACKGROUND ART

In recent years, environments for developing oil or gas wells have become increasingly harsh, and efforts to lower production costs have been continued in order to improve profitability. When extracting oil and gas, steel pipes for oil wells are applied up to 5 km from a top to a bottom of an oil field. As a mining depth of oil wells increases, steel pipes used for oil wells having high strength, internal and external pressure crush strength, toughness, and delayed fracture resistance, and the like are required. In addition, as mining environments become harsh, mining costs increase rapidly, and efforts to reduce costs are continuing. In particular, steel pipes for oil wells used for maintenance and maintenance of oil wells are subjected to repeated bending during use, and thus require high elongation as well as high strength. When elongation of the steel pipe is reduced, a material may be broken even with low external deformation.

In this manner, as mining depths increase, a ground pressure may increase, so that a high strength steel is required, and when the high strength steel is used, a thickness of the pipe can be reduced, thereby reducing a construction period such as construction and repair. In general, when strength increases, elongation decreases, but in order to secure the stability of the oil well, elongation similar to that of existing low-strength materials is required.

DISCLOSURE

Technical Problem

An aspect of the present disclosure is to provide a high strength hot rolled steel sheet having excellent elongation and a method for manufacturing the same.

Technical Solution

According to an aspect of the present disclosure, a high strength hot rolled steel sheet having excellent elongation contains, by wt %, 0.11 to 0.14% of C, 0.20 to 0.50% of Si, 1.8 to 2.0% of Mn, 0.03% less of P, 0.02% or less of S, 0.01 to 0.04% of Nb, 0.5 to 0.8% of Cr, 0.01 to 0.03% of Ti, 0.2 to 0.4% of Cu, 0.1 to 0.4% of Ni, 0.2 to 0.4% of Mo, 0.007% or less of N, 0.001 to 0.006% of Ca, 0.01 to 0.05% of Al, a balance of Fe, and inevitable impurities, in which relational expressions 1 to 3 below are satisfied, and a microstructure contains, by area %, 88% or more of bainite (excluding 100%), 10% or less of ferrite (excluding 0%), 2% or less of pearlite (excluding 0%), and 0.8% or less of martensite-austenite constituent (including 0%).

$$7 \leq (Mo/93)/(P/31) \leq 16 \quad \text{[Relational Expression 1]}$$

$$1.6 \leq Cr+3Mo+2Ni \leq 2 \quad \text{[Relational Expression 2]}$$

$$6 \leq (3C/12+Mn/55) \times 100 \leq 7 \quad \text{[Relational Expression 3]}$$

(in relational expressions 1 to 3, the contents of alloying elements are based on wt %).

According to another aspect of the present disclosure, a method for manufacturing a high strength hot rolled steel sheet having excellent elongation includes: reheating a steel slab satisfying conditions of relational expressions 1 to 3 below at 1100 to 1180° C., the steel slab containing, by wt %, 0.11 to 0.14% of C, 0.20 to 0.50% of Si, 1.8 to 2.0% of Mn, 0.03% or less of P, 0.02% or less of S, 0.01 to 0.04% of Nb, 0.5 to 0.8% of Cr, 0.01 to 0.03% of Ti, 0.2 to 0.4% of Cu, 0.1 to 0.4% of Ni, 0.2 to 0.4% of Mo, 0.007% or less of N, 0.001 to 0.006% of Ca, 0.01 to 0.05% of Al, a balance of Fe, and inevitable impurities; extracting the reheated steel slab after maintaining the reheated steel slab at 1150° C. or higher for 45 minutes or longer; primarily rolling the extracted steel slab at 850 to 930° C. to obtain steel; secondarily rolling the steel at 740 to 795° C.; water-cooling the secondarily rolled steel at a cooling rate of 10 to 50° C./s; and coiling the water-cooled steel at 440 to 530° C.

Advantageous Effects

As set forth above, according to an exemplary embodiment in the present disclosure, it is possible to provide a high strength hot rolled steel sheet having excellent elongation and a method for manufacturing the same.

BEST MODE FOR INVENTION

Hereinafter, a high strength hot rolled steel sheet having excellent elongation according to an exemplary embodiment in the present disclosure will be described. First, an alloy composition of the present disclosure will be described. However, a unit of the alloy composition described below is wt % unless otherwise stated.

C: 0.11 to 0.14%

C is an element that increases hardenability of steel, and when the content is lower than 0.11%, hardenability is insufficient, so the target strength in the present disclosure may not be secured. On the other hand, when the content exceeds 0.14%, yield strength may become too high, so processing may become difficult or elongation may deteriorate, which is not preferable. Accordingly, the content of C preferably has a range of 0.11 to 0.14%. A lower limit of the content of C is more preferably 0.115%, even more preferably 0.118%, and most preferably 0.12%. An upper limit of the content of C is more preferably 0.138%, even more preferably 0.136%, and most preferably 0.135%.

Si: 0.20~0.50%

Si acts to increase activity of C in a ferrite phase, promotes ferrite stabilization, and contributes to securing strength by solid solution strengthening. In addition, Si forms a low melting point oxide such as $Mn_2SiO_4$ during ERW welding and allows the oxide to be easily discharged during welding. When the content is lower than 0.20%, a cost problem may occur during steelmaking, whereas when the content exceeds 0.50%, the amount of formation of $SiO_2$ oxide having a high melting point other than $Mn_2SiO_4$ increases, and toughness of a welded portion may be reduced during electric resistance welding. Accordingly, the content of Si preferably has a range of 0.20 to 0.50%. A lower limit of the content of Si is more preferably 0.23%, even more preferably 0.26%, and most preferably 0.3%. An upper limit of the content of C is more preferably 0.46%, even more preferably 0.43%, and most preferably 0.4%.

Mn: 1.8 to 2.0%

Mn is an element that significantly affects austenite/ferrite transformation initiation temperature and lowers the transformation initiation temperature, and affects toughness of a pipe base material portion and a welded portion, and contributes to increasing strength as a solid solution strengthening element. When the content is lower than 1.8%, it is difficult to expect the above effect, whereas when the content exceeds 2.0%, there is a high possibility of segregation zone. Accordingly, the content of Mn preferably has a range of 1.8 to 2.0%. A lower limit of the content of Mn is more preferably 1.83%, even more preferably 1.86%, and most preferably 1.9%. An upper limit of the content of Mn is more preferably 1.98%, even more preferably 1.96%, and most preferably 1.94%.

P: 0.03% or Less

P is an element that is inevitably contained during steelmaking, and when P is added, P may be segregated in a center of the steel sheet and used as a crack initiation point or a propagation path. In theory, it is advantageous to limit a content of P to 0%, but it may be inevitably added as an impurity in the manufacturing process. Therefore, it is important to manage the upper limit, and in the present disclosure, it is preferable to limit the upper limit of the content of P to 0.03%. The content of P is more preferably 0.025% or less, even more preferably 0.02% or less, and most preferably 0.01% or less.

S: 0.02% or Less

S is an impurity element present in the steel and is combined with Mn and the like to form non-metallic inclusions, so S greatly impairs the toughness of the steel. Therefore, it is preferable to reduce the content of S as much as possible. According to the present disclosure, it is preferable to reduce the content of S to 0.02 or less. The content of S is more preferably 0.01% or less, even more preferably 0.005% or less, and most preferably 0.003% or less.

Nb: 0.01 to 0.04%

Nb is a very useful element for refining grains by suppressing recrystallization during rolling, and at the same time, acts to improve the strength of steel. Accordingly, at least 0.01% or more of Nb should be added. On the other hand, when Nb exceeds 0.04%, excessive Nb carbonitride precipitates and is harmful to the elongation of steel. Accordingly, the content of Nb preferably has a range of 0.01 to 0.04%. A lower limit of the content of Nb is more preferably 0.012%, even more preferably 0.014%, and most preferably 0.015%. An upper limit of Nb content is more preferably 0.039%, and even more preferably 0.038%.

Cr: 0.5 to 0.8%

Cr is an element that improves hardenability and corrosion resistance. When the content of Cr is lower than 0.5%, the effect of improving corrosion resistance due to the addition is insufficient, whereas when the content of Cr exceeds 0.8%, weldability may rapidly deteriorate, which is not preferable. Accordingly, the content of Cr preferably has a range of 0.5 to 0.8%. A lower limit of the content of Cr is more preferably 0.52%, even more preferably 0.54%, and most preferably 0.55%. An upper limit of the content of Cr is more preferably 0.75%, even more preferably 0.7%, and most preferably 0.65%.

Ti: 0.01 to 0.03%

Ti is an element that combines with nitrogen (N) in steel to form TiN precipitates. In the case of the present disclosure, since excessive coarsening of some grains of austenite may occur during hot rolling at high temperature, TiN appropriately precipitates, and thus, the growth of grains of the austenite may be suppressed. To this end, it is necessary to add at least 0.01% of Ti. However, when the content exceeds 0.03%, the effect is not only saturated, but rather coarse TiN is crystallized, so the effect may be halved, which is not preferable. Accordingly, the content of Ti preferably has a range of 0.01 to 0.03%. A lower limit of the content of Ti is more preferably 0.011%, even more preferably 0.012%, and most preferably 0.013%. An upper limit of the content of Ti is more preferably 0.026%, even more preferably 0.023%, and most preferably 0.02%.

Cu: 0.2 to 0.4%

Cu is effective in improving hardenability and corrosion resistance of the base material or welded portion. However, when the content is lower than 0.2%, it is disadvantageous to secure the corrosion resistance, whereas when the content exceeds 0.4%, the manufacturing cost increases, resulting in an economic disadvantage. Accordingly, the content of Cu preferably has a range of 0.2 to 0.4%. A lower limit of the content of Cu is more preferably 0.22%, even more preferably 0.24%, and most preferably 0.25%. An upper limit of the content of Cu is more preferably 0.37%, even more preferably 0.34%, and most preferably 0.3%.

Ni: 0.1 to 0.4%

Ni is effective in improving hardenability and corrosion resistance. In addition, when Ni is added together with Cu, since Ni reacts with Cu, Ni inhibits a formation of Cu having a low melting point alone, and thus, has an effect of suppressing the occurrence of cracks during hot processing. Ni is an element that is also effective in improving the toughness of the base material. In order to obtain the above-described effect, it is necessary to add Ni in an amount of 0.1% or more, but since Ni is an expensive element, the addition of Ni in excess of 0.4% is disadvantageous in terms of economy. Accordingly, the content of Ni preferably has a range of 0.1 to 0.4%. A lower limit of the content of Ni is more preferably 0.12%, even more preferably 0.13%, and most preferably 0.14%. An upper limit of the content of Ni is more preferably 0.46%, even more preferably 0.43%, and most preferably 0.3%.

Mo: 0.2 to 0.4%

Mo is very effective in increasing a strength of a material, and may secure good impact toughness by suppressing a formation of a large amount of pearlite structure. In order to secure the effect, it is preferable to add at least 0.2% of Moto secure the effect. However, when the content exceeds 0.4%, Mo is an expensive element, which is economically disadvantageous. Further, when the content exceeds 0.4%, low-temperature cracking of welding may occur, and a low-temperature transformation phase such as an MA structure may occur in the base material, resulting in a decrease in toughness. Accordingly, the content of Mo preferably has a range of 0.2 to 0.4%. A lower limit of the content of Mo is more preferably 0.21%, even more preferably 0.22%, and most preferably 0.23%. An upper limit of the content of Mn is more preferably 0.39%, even more preferably 0.38%, and most preferably 0.37%.

N: 0.007% or Less

Since N is a cause of aging deterioration in a solid solution state, N is fixed as a nitride such as Ti or Al. When the content exceeds 0.007%, an increase in the amount of added Ti, Al, or the like, is inevitable, and thus, the content of N is preferably limited to 0.007% or less. The content of N is more preferably 0.0065% or less, even more preferably 0.006% or less, and most preferably 0.0055% or less.

Ca: 0.001 to 0.006%

Ca is added to control a shape of emulsion. When the content exceeds 0.006%, CaS of a CaO cluster may be generated with respect to S in the steel, whereas when the content is lower than 0.001%, MnS may be generated and elongation may decrease. In addition, if the amount of S is large, it is preferable to control the amount of S at the same time in order to prevent the occurrence of CaS clusters. That is, it is preferable to appropriately control the amount of Ca according to the amount of S and O in the steel. A lower limit of the content of Ca is more preferably 0.0014%, even more preferably 0.0018%, and most preferably 0.002%. An upper limit of the content of Ca is more preferably 0.0055%, even more preferably 0.005%, and most preferably 0.0045%.

Al: 0.01 to 0.05%

Al is added for deoxidation during steelmaking. When the content is lower than 0.01%, such an action is insufficient, whereas when the content exceeds 0.05%, the formation of alumina or a composite oxide containing alumina oxide may be promoted in the welded portion during electric resistance welding and the toughness of the welded portion may be impaired. Accordingly, the content of Al preferably has a range of 0.01 to 0.05%. A lower limit of the content of Al is more preferably 0.015%, even more preferably 0.02%, and most preferably 0.025%. An upper limit of the content of Al is more preferably 0.046%, even more preferably 0.043%, and most preferably 0.04%.

The remaining component of the present disclosure is iron (Fe). However, in a general manufacturing process, unintended impurities may inevitably be mixed from a raw material or the surrounding environment, and thus, these impurities may not be excluded. Since these impurities are known to anyone of ordinary skill in the manufacturing process, all the contents are not specifically mentioned in the present specification.

On the other hand, in the present disclosure, it is preferable to satisfy not only the above-described alloy composition, but also the following relational expressions 1 to 3. In relational expressions 1 to 3, the contents of alloying elements are based on wt %.

$$7 \leq (Mo/93)/(P/31) \leq 16 \quad \text{[Relational Expression 1]}$$

Relational Expression 1 is for preventing a grain boundary segregation of P. When the value of the relational expression 1 is less than 19, the effect of the grain boundary segregation of P due to the formation of the Fe—Mo—P compound is insufficient, and when the value of the relational expression 1 exceeds 30, the impact energy decreases due to the formation of the low-temperature transformation phase due to the increase in the hardenability.

$$1.6 \leq Cr+3Mo+2Ni \leq 2 \quad \text{[Relational Expression 2]}$$

Relational Expression 2 is for suppressing the formation of the martensite-austenite constituent (MA) phase, which is a hard second phase structure. When the value of the relational expression 2 is less than 1.6, the hardenability due to the addition of Cr, Mo, and Ni decreases, so strength is lacking, and when the value of the relational expression 2 exceeds 2, MA is formed, and thus, the elongation decreases.

$$6 \leq (3C/12+Mn/55) \times 100 \leq 7 \quad \text{[Relational Expression 3]}$$

Relational Expression 3 is for suppressing the formation of the martensite-austenite constituent (MA) phase, which is the hard second phase structure. The increase in C and Mn lowers a solidification temperature of a slab to promote the segregation in the center of the slab, and narrows a formation section of delta ferrite to make it difficult to homogenize the slab during continuous casting. In addition, Mn is a representative element segregated in the center of the slab, and promotes the formation of the second phase that impairs the ductility of the pipe, and the increase in C intensifies segregation by widening the coexistence section of the solid and liquid phases during the continuous casting. Therefore, when the value of the relational expression 3 exceeds 7, the strength increases, but for the above reason, the inhomogeneity of the slab increases to form the hard second phase in the slab, thereby lowering the low-temperature toughness of the steel and pipe. On the other hand, when the value of the relational expression 3 is less than 6, there is a disadvantage of lowering the strength.

The hot rolled steel sheet according to the present disclosure preferably contains microstructure that contains, by area %, 88% or more of bainite (excluding 100%), 10% or less of ferrite (excluding 0%), 2% or less of pearlite (excluding 0%), and 0.8% or less of martensite-austenite constituent (including 0%). When the fraction of the bainite is lower than 88%, it is difficult to obtain a yield strength of 850 MPa or more to be obtained by the present disclosure. When the fraction of ferrite exceeds 10%, there is a disadvantage of lowering the strength. When the fraction of the pearlite exceeds 2%, there is a disadvantage of decreasing the elongation. When the fraction of the martensite-austenite constituent exceeds 0.8%, the martensite-austenite constituent acts as a starting point for the generation of cracks, resulting in a problem that the elongation decreases. Meanwhile, in the present disclosure, the martensite-austenite constituent may not be contained.

It is preferable that the average grain size of the bainite is 8 μm or less. When the average grain size of the bainite exceeds 8 μm, the resistance to crack propagation decreases, so there is a high possibility of a problem of decreasing the toughness and elongation and lowering the strength.

It is preferable that the average grain size of the ferrite is 10 μm or less. When the average grain size of the ferrite exceeds 10 μm, there is a disadvantage of lowering strength.

It is preferable that the average grain size of the pearlite is 4 μm or less. When the average grain size of the pearlite exceeds 4 μm, there is a disadvantage in that cracks easily occur and elongation decreases.

It is preferable that the average grain size of the martensite-austenite constituent is 1 μm or less. When the average grain size of the martensite-austenite constituent exceeds 1 μm, there is a disadvantage in that cracks easily occur and elongation decreases.

The hot rolled steel sheet of the present disclosure provided as described above may secure excellent strength and elongation with a yield strength of 850 MPa or more at room temperature, a tensile strength of 900 MPa or more at room temperature, and a total elongation of 13% or more.

Hereinafter, a method for manufacturing a high strength hot rolled steel sheet having excellent elongation according to an exemplary embodiment in the present disclosure will be described.

First, the steel slab satisfying the above-described alloy composition and relational expressions 1 to 3 is reheated at 1100 to 1180° C. The heating process of the steel slab is a process of heating steel so that a subsequent rolling process may be performed smoothly and sufficient properties in the target steel sheet may be obtained. Therefore, the heating process needs to be performed within an appropriate temperature range for the purpose. In the reheating the steel slab, the steel slab should be uniformly heated so that the precipitated elements inside the steel plate are sufficiently dissolved, and the formation of coarse grains due to too high a heating temperature needs to be prevented. The reheating temperature of the steel slab is preferably performed to be 1100 to 1180° C., which is for solidification and homogenization of the cast structure, segregation, secondary phases produced in the slab manufacturing process. When the reheating temperature of the steel slab is lower than 1100° C., the homogenization is insufficient or the temperature of the heating furnace is too low to increase the deformation resistance during the hot rolling, and when the reheating temperature of the steel slab exceeds 1180° C., the deterioration of surface quality may occur. Therefore, the reheating temperature of the slab preferably has the range of 1100 to 1180° C. A lower limit of the reheating temperature is more preferably 1115° C., even more preferably 1130° C., and most preferably 1150° C. An upper limit of the reheating temperature is more preferably 1178° C., even more preferably 1177° C., and most preferably 1176° C.

Then, the reheated steel slab is extracted after maintained at 1150° C. or higher for 45 minutes or longer. When the extraction temperature of the steel slab is lower than 1150° C., Nb is insufficiently dissolved, so the strength may decrease. When the holding time before the extraction of the steel slab is shorter than 45 minutes, the thickness of the slab and the degree of cracking in the longitudinal direction are low, so rollability may be inferior and the deviation in properties of the final steel sheet may be caused. On the other hand, when the reheating temperature of the steel slab is lower than 1150° C. which is the lower limit of the extraction temperature, a process of reheating the steel slab may be additionally included at an end of the reheating process so that the temperature of the steel slab is 1150° C. or higher. When the reheating temperature of the steel slab is higher than 1150° C. which is the lower limit of the extraction temperature, the steel slab may be extracted as is.

Thereafter, the extracted steel slab is primarily rolled at 850 to 930° C. to obtain steel. When the primary rolling end temperature exceeds 930° C., the grain refining effect is insufficient, and when the primary rolling end temperature is lower than 850° C., there may be an equipment load problem in the subsequent finish rolling process. Therefore, the primary rolling end temperature preferably has a range of 850 to 930° C. A lower limit of the primary rolling end temperature is more preferably 855° C., even more preferably 860° C., and most preferably 870° C. An upper limit of the primary rolling end temperature is more preferably 925° C., even more preferably 920° C., and most preferably 910° C.

Thereafter, the steel is rolled and secondary rolling is performed at 740 to 795° C. When the secondary rolling end temperature exceeds 795° C., the final structure becomes coarse, so that desired strength may not be obtained, and when the secondary rolling end temperature is lower than 740° C., a problem of an equipment load in a finishing rolling mill may occur. Therefore, the secondary rolling end temperature preferably has a range of 740 to 795° C. A lower limit of the secondary rolling end temperature is more preferably 745° C., even more preferably 750° C., and most preferably 760° C. An upper limit of the secondary rolling end temperature is more preferably 792° C., even more preferably 788° C., and most preferably 785° C.

On the other hand, in the present disclosure, the secondary rolling corresponds to non-recrystallized rolling. It is preferable that the cumulative reduction ratio during the secondary rolling corresponding to the non-recrystallized rolling is 85% or more. When the cumulative reduction ratio is lower than 85%, a mixed structure may occur and the elongation may decrease. Therefore, it is preferable that the cumulative reduction ratio during the secondary rolling is 85% or more. Therefore, it is preferable that the cumulative reduction ratio during the secondary rolling is more preferably 87% or more, even more preferably 89% or more, and most preferably 90% or more.

Thereafter, the secondarily rolled steel is water-cooled at a cooling rate of 10 to 50° C./s. When the cooling rate exceeds 50° C./s, there is a disadvantage in that a large amount of low-temperature transformation phase such as MA is generated, and when the cooling rate is less than 10° C./s, there is a disadvantage in that the coarse pearlite increases. Accordingly, the cooling rate preferably has a range of 10 to 50° C./s. A lower limit of the cooling rate is more preferably 12° C./s, even more preferably 14° C./s, and most preferably 16° C./s. An upper limit of the cooling rate is more preferably 47° C./s, even more preferably 43° C./s, and most preferably 40° C./s.

Thereafter, the water-cooled steel is coiled at 440 to 530° C. When the coiling temperature exceeds 530° C., the surface quality deteriorates, and coarse carbides are formed, thereby reducing the strength. On the other hand, when the temperature is lower than 440° C., a large amount of cooling water is required during the coiling, and the load is greatly increased during the coiling, and the martensite is generated, resulting in the decrease in elongation. Accordingly, the coiling temperature preferably has a range of 440 to 530° C. A lower limit of the coiling temperature is more preferably 455° C., even more preferably 470° C., and most preferably 480° C. An upper limit of the coiling temperature is more preferably 520° C., even more preferably 515° C., and most preferably 510° C.

MODE FOR INVENTION

Hereinafter, the present disclosure will be described in more detail through Inventive Examples. It should be noted that the following examples are for describing exemplary examples of the present disclosure, and the scope of the present disclosure is not limited by the following examples. This is because the scope of the present disclosure is determined by matters described in the claims and matters able to be reasonably inferred therefrom.

Inventive Example

After the molten steel having the alloy composition shown in Tables 1 and 2 below was manufactured as a steel slab by a continuous casting method, the steel slab was heated at 1100 to 1180° C., and then reheated, extracted, rolled, coiled, and cooled under the conditions shown in Table 3 below, thereby manufacturing the hot-rolled steel sheet having a thickness of 5 mm. The type and fraction of the microstructure, the average grain size, and mechanical properties of the hot rolled steel sheet thus manufactured were measured, and then were shown in Table 4 below.

TABLE 1

| Steel type No. | Alloy Composition (wt %) C | Si | Mn | P | S | Nb | Cr | Ti | Cu |
|---|---|---|---|---|---|---|---|---|---|
| Inventive Steel No. 1 | 0.136 | 0.338 | 1.98 | 0.008 | 0.001 | 0.038 | 0.60 | 0.014 | 0.270 |
| Inventive Steel No. 2 | 0.136 | 0.339 | 1.92 | 0.007 | 0.0013 | 0.015 | 0.61 | 0.015 | 0.275 |
| Inventive Steel No. 3 | 0.136 | 0.324 | 1.80 | 0.0067 | 0.0017 | 0.015 | 0.60 | 0.014 | 0.274 |
| Inventive Steel No. 4 | 0.138 | 0.372 | 1.92 | 0.0098 | 0.0013 | 0.037 | 0.62 | 0.017 | 0.285 |
| Inventive Steel No. 5 | 0.127 | 0.320 | 1.84 | 0.0107 | 0.0015 | 0.037 | 0.0 | 0.012 | 0.270 |
| Comparative Steel No. 1 | 0.16 | 0.35 | 1.98 | 0.018 | 0.001 | 0.02 | 0.55 | 0.015 | 0.270 |
| Comparative Steel No. 2 | 0.13 | 0.33 | 2.10 | 0.012 | 0.0013 | 0.03 | 0.54 | 0.02 | 0.272 |
| Comparative Steel No. 3 | 0.14 | 0.35 | 1.98 | 0.013 | 0.0017 | 0.02 | 0.53 | 0.018 | 0.279 |
| Comparative Steel No. 4 | 0.13 | 0.34 | 2.10 | 0.0124 | 0.0013 | 0.022 | 0.52 | 0.019 | 0.262 |
| Comparative Steel No. 5 | 0.08 | 0.35 | 1.80 | 0.0107 | 0.0015 | 0.021 | 0.54 | 0.011 | 0.274 |

TABLE 2

| Steel type No. | Alloy Composition (wt %) Ni | Mo | N | Ca | Al | Relational Expression 1 | Relational Expression 2 | Relational Expression 3 |
|---|---|---|---|---|---|---|---|---|
| Inventive Steel No. 1 | 0.168 | 0.365 | 0.005 | 0.0021 | 0.032 | 15.2 | 2.0 | 7.0 |
| Inventive Steel No. 2 | 0.167 | 0.309 | 0.004 | 0.0025 | 0.0038 | 14.7 | 1.9 | 6.9 |
| Inventive Steel No. 3 | 0.169 | 0.315 | 0.003 | 0.0028 | 0.034 | 15.7 | 1.9 | 6.7 |
| Inventive Steel No. 4 | 0.172 | 0.255 | 0.004 | 0.0025 | 0.034 | 8.7 | 1.7 | 6.9 |
| Inventive Steel No. 5 | 0.169 | 0.241 | 0.005 | 0.0029 | 0.035 | 7.5 | 1.7 | 6.5 |
| Comparative Steel No. 1 | 0.150 | 0.320 | 0.005 | 0.0021 | 0.0032 | 5.9 | 1.8 | 7.6 |
| Comparative Steel No. 2 | 0.140 | 0.220 | 0.004 | 0.0025 | 0.038 | 6.1 | 15 | 7.1 |
| Comparative Steel No. 3 | 0.142 | 0.150 | 0.003 | 0.0028 | 0.034 | 3.8 | 1.3 | 7.1 |
| Comparative Steel No. 4 | 0.148 | 0.210 | 0.004 | 0.0025 | 0.034 | 5.6 | 1.4 | 7.1 |
| Comparative Steel No. 5 | 0.141 | 0.180 | 0.005 | 0.0029 | 0.035 | 5.6 | 1.4 | 5.3 |

[Relational Expression 1] (Mo/93)/(P/31)
[Relational Expression 2] Cr + 3Mo + 2Ni
[Relational Expression 3] (3C/12 + Mn/55) × 100

TABLE 3

| Division | Steel type No. | Reheating Temperature (° C.) | Holding Time at 1150° C. or higher (Minute) | Non-recrystallized Average Reduction Ratio (%) | Primary Rolling End Temperature (° C.) | Secondary Rolling End Temperature (° C.) | Cooling Rate (° C./s) | Coiling Temperature (° C.) |
|---|---|---|---|---|---|---|---|---|
| Inventive Example 1 | Inventive Steel No. 1 | 1156 | 66 | 91 | 880 | 785 | 18 | 501 |
| Inventive Example 2 | Inventive Steel No. 2 | 1176 | 67 | 86 | 893 | 781 | 21 | 512 |
| Inventive Example 3 | Inventive Steel No. 3 | 1156 | 62 | 89 | 915 | 776 | 22 | 598 |
| Inventive Example 4 | Inventive Steel No. 4 | 1162 | 67 | 92 | 905 | 780 | 32 | 493 |

TABLE 3-continued

| Division | Steel type No. | Reheating Temperature (° C.) | Holding Time at 1150° C. or higher (Minute) | Non-recrystallized Average Reduction Ratio (%) | Primary Rolling End Temperature (° C.) | Secondary Rolling End Temperature (° C.) | Cooling Rate (° C./s) | Coiling Temperature (° C.) |
|---|---|---|---|---|---|---|---|---|
| Inventive Example 5 | Inventive Steel No. 5 | 1172 | 62 | 90 | 923 | 764 | 27 | 502 |
| Comparative Example 1 | Comparative Steel No. 1 | 1277 | 78 | 88 | 944 | 798 | 21 | 503 |
| Comparative Example 2 | Comparative Steel No. 2 | 1182 | 62 | 92 | 968 | 819 | 19 | 515 |
| Comparative Example 3 | Comparative Steel No. 3 | 1178 | 63 | 88 | 932 | 822 | 23 | 520 |
| Comparative Example 4 | Comparative Steel No. 4 | 1167 | 68 | 87 | 923 | 861 | 24 | 545 |
| Comparative Exampl e 5 | Comparative Steel No. 5 | 1181 | 71 | 91 | 943 | 862 | 19 | 515 |
| Comparative Example 6 | Inventive Steel No. 1 | 1165 | 58 | 89 | 948 | 833 | 20 | 563 |
| Comparative Example 7 | Inventive Steel No. 2 | 1124 | 53 | 90 | 937 | 867 | 19 | 583 |

TABLE 4

| | Ferrite | | Pearlite | | Bainite | | Martensite-austenite constituent | | Yield | Tensile | Total |
|---|---|---|---|---|---|---|---|---|---|---|---|
| Division | Fraction (area %) | Size (μm) | Fraction (area %) | Size (μm) | Fraction (area %) | Size (μm) | Fraction (area %) | Size (μm) | Strength (MPa) | Strength (MPa) | Elongation (%) |
| Inventive Example 1 | 7.2 | 6 | 1 | 2 | 91 | 6 | 0.8 | 1 | 1010 | 1120 | 15.2 |
| Inventive Example 2 | 9.4 | 6 | 1 | 3 | 89 | 7 | 0.6 | 1 | 952 | 1110 | 14.5 |
| Inventive Example 3 | 10 | 7 | 2 | 3 | 88 | 4 | 0 | — | 904 | 970 | 15.4 |
| Inventive Example 4 | 5.5 | 6 | 1 | 3 | 93 | 5 | 0.5 | 1 | 907 | 970 | 14.5 |
| Inventive Example 5 | 9 | 8 | 2 | 2 | 89 | 6 | 0 | — | 908 | 976 | 15.6 |
| Comparative Example 1 | 8 | 5 | 1 | 2 | 88 | 6 | 3 | 2 | 1230 | 1150 | 10.2 |
| Comparative Example 2 | 10 | 6 | 1 | 2 | 87 | 6 | 2 | 1 | 1014 | 1135 | 11 |
| Comparative Example 3 | 5 | 7 | 2 | 3 | 91 | 5 | 2 | 1 | 958 | 1011 | 12 |
| Comparative Example 4 | 13 | 13 | 4 | 3 | 83 | 10 | 0 | — | 881 | 943 | 14.3 |
| Comparative Example 5 | 8 | 9 | 5 | 2 | 87 | 9 | 0 | — | 654 | 872 | 21 |
| Comparative Example 6 | 14 | 15 | 7 | 4 | 79 | 14 | 0 | — | 876 | 832 | 18 |
| Comparative Example 7 | 16 | 18 | 12 | 5 | 72 | 16 | 0 | — | 758 | 893 | 19.2 |

As may be seen from Tables 1 to 4, in the case of Inventive Examples 1 to 5 satisfying the alloy composition, the component relational expressions, and the manufacturing conditions proposed by the present disclosure, the microstructure having the fine grain size of the appropriate fraction is included in an appropriate fraction, so it may be seen that the excellent yield strength, tensile strength and elongation are secured.

However, in the case of Comparative Examples 1 to 5 that do not satisfy the alloy composition, the component relational expressions, and the manufacturing conditions proposed by the present disclosure, it was found that the yield strength, the tensile strength, or the elongation was low as the microstructure of the present disclosure was not secured.

Comparative Examples 6 and 7 are cases in which the alloy composition and the component relational expression proposed by the present disclosed are satisfied, but it may be seen that the manufacturing conditions are not satisfied, and the yield strength, the tensile strength, or the elongation is at a low level as the microstructure of the present disclosure is not secured.

The invention claimed is:

1. A hot rolled steel sheet-having excellent elongation, comprising:

by wt %, 0.11 to 0.14% of C, 0.20 to 0.50% of Si, 1.8 to 2.0% of Mn, 0.03% or less of P, 0.02% or less of S, 0.01 to 0.04% of Nb, 0.5 to 0.8% of Cr, 0.01 to 0.03% of Ti, 0.2 to 0.4% of Cu, 0.1 to 0.4% of Ni, 0.2 to 0.4% of Mo, 0.007% or less of N, 0.001 to 0.006% of Ca, 0.01 to 0.05% of Al, a balance of Fe, and inevitable impurities, wherein relational expressions 1 to 3 below are satisfied, and a microstructure comprises, by area %, 88% or more of bainite, excluding 100%, 10% or less of ferrite, excluding 0%, 2% or less of pearlite, excluding 0%, and 0.8% or less of martensite-austenite constituent, inclusive of 0%, $$7 \leq (Mo/93)/(P/31) \leq 16 \quad \text{[Relational Expression 1]}$$

$$1.6 \leq Cr+3Mo+2Ni \leq 2 \quad \text{[Relational Expression 2]}$$

$$6 \leq (3C/12+Mn/55) \times 100 \leq 7 \quad \text{[Relational Expression 3]}$$

where, in relational expressions 1 to 3, the contents of alloying elements are based on wt %.

2. The hot rolled steel sheet of claim 1, wherein an average grain size of the bainite is 8 μm or less.

3. The hot rolled steel sheet of claim 1, wherein an average grain size of the ferrite is 10 μm or less.

4. The hot rolled steel sheet of claim 1, wherein an average grain size of the pearlite is 4 μm or less.

5. The hot rolled steel sheet of claim 1, wherein an average grain size of the martensite-austenite constituent is 1 μm or less.

6. The hot rolled steel sheet of claim 1, wherein the hot rolled steel sheet has a yield strength of 850 MPa or more at room temperature, a tensile strength of 900 MPa or more at room temperature, and a total elongation of 13% or more.

* * * * *